US005641040A

United States Patent [19]

Grass

[11] Patent Number: 5,641,040

[45] Date of Patent: Jun. 24, 1997

[54] DRIVE FOR A FREIGHT ELEVATOR, IN PARTICULAR FOR A STAIR CLIMBER FOR THE HANDICAPPED

[75] Inventor: Gerd Grass, Detmold, Germany

[73] Assignee: Thyssen Treppenlifte GmbH, Lemgo, Germany

[21] Appl. No.: 539,845

[22] Filed: Oct. 6, 1995

Related U.S. Application Data

[63] Continuation of PCT/EP94/01040, Apr. 2, 1994.

[51] Int. Cl.[6] ..... B66B 9/08

[52] U.S. Cl. ..... 187/201; 187/245

[58] Field of Search ..... 187/201, 200, 187/245, 270; 414/921

[56] References Cited

FOREIGN PATENT DOCUMENTS 1156595 11/1983 Canada ..... 187/201

2184707 7/1987 United Kingdom ..... 187/201

*Primary Examiner*—Kenneth Noland

*Attorney, Agent, or Firm*—Herbert L. Lerner; Laurence A. Greenberg

[57] ABSTRACT

A drive assembly for a freight elevator or a stair climber for the handicapped is guided on at least one supporting waling or spar. A driving strip is disposed on the supporting waling or spar. According to one embodiment, the driving strip has recesses formed therein at equal intervals. A load-receiving configuration has a motor-driven drive wheel and drive elements are adapted to the recesses for form-lockingly engaging the drive wheel with the recesses. According to another embodiment, squared blocks of constant length are secured to the supporting waling or spar at equal spacings. A load-receiving configuration has a motor-driven drive wheel and drive elements are adapted to the spacings of the blocks for form-lockingly engaging the squared blocks with the drive wheel.

6 Claims, 4 Drawing Sheets

18
15
14
32
34
35
12
31
28
36

DRIVE FOR A FREIGHT ELEVATOR, IN PARTICULAR FOR A STAIR CLIMBER FOR THE HANDICAPPED

CROSS-REFERENCE TO RELATED APPLICATION

This application is a Continuation of International Application Ser. No. PCT/EP94/01040, filed Apr. 2, 1994.

BACKGROUND OF THE INVENTION

Field of the Invention

The invention relates to a drive for a freight elevator, particularly for a stair climber for the handicapped, being guided on at least one supporting waling or spar.

Known stair climbers as a rule have two supporting walings, on which the load-receiving configuration or the elevator or lift for the handicapped is guided through the use of rollers. The drive of the load-receiving configuration is carried out, for instance, in force-locking fashion (German Patent DE-PS 29 14 350) through a special drive waling or spar or through rollers that rest in stationary fashion on the supporting walings and are driven, or are disposed in form-locking fashion (German Patent DE-PS 31 03 162) in stationary fashion on or in the supporting walings. A form-locking connection is one which connects two elements together due to the shape of the elements themselves, as opposed to a force-locking connection, which locks the elements together by force external to the elements. The force-locking drive using paired opposed rollers that engage the supporting spars or walings requires considerable contact pressure and a corresponding load capacity of the bearing, as well as wear-resistant material, and is therefore correspondingly expensive.

SUMMARY OF THE INVENTION

It is accordingly an object of the invention to provide a drive for a freight elevator, in particular for a stair climber for the handicapped, which overcomes the hereinaforementioned disadvantages of the heretofore-known devices of this general type, which is a novel form-locking drive for a load-receiving configuration guided on rollers on two supporting walings, which is less expensive in its construction, is more flexibly adaptable to guiding a freight elevator, particularly for the handicapped, in the most favorable way over distances and up and down stairs, and which is more economical in operation.

With the foregoing and other objects in view there is provided, in accordance with the invention, a drive assembly for a freight elevator or for a stair climber for the handicapped, comprising at least one supporting waling on which the drive is guided; a driving strip disposed on the supporting waling, the driving strip having recesses formed therein at equal intervals; a load-receiving configuration having a motor-driven drive wheel; and drive elements being adapted to the recesses for form-lockingly engaging the drive wheel with the recesses.

In accordance with another feature of the invention, the driving strip has an outer edge and the recesses are formed in the outer edge in the shape of a U with parallel sides.

In accordance with a further feature of the invention, the driving strip has an inner edge opposite the outer edge, and the inner edge has notches formed therein at equal intervals.

In accordance with an added feature of the invention, the driving strip has webs between the recesses, the webs have centers at which bores are formed at right angles to a lengthwise extension of the driving strip, and the notches terminate in the bores.

With the objects of the invention in view, there is also provided a drive assembly for a freight elevator or for a stair climber for the handicapped, comprising at least one supporting waling on which the drive is guided; squared blocks of constant length being secured to the supporting waling at equal spacings; a load-receiving configuration having a motor-driven drive wheel; and drive elements being adapted to the spacings of the blocks for form-lockingly engaging the squared blocks with the drive wheel.

Other features which are considered as characteristic for the invention are set forth in the appended claims.

Although the invention is illustrated and described herein as constructed in drive for a freight elevator, in particular for a stair climber for the handicapped, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figures 1A, 1B:
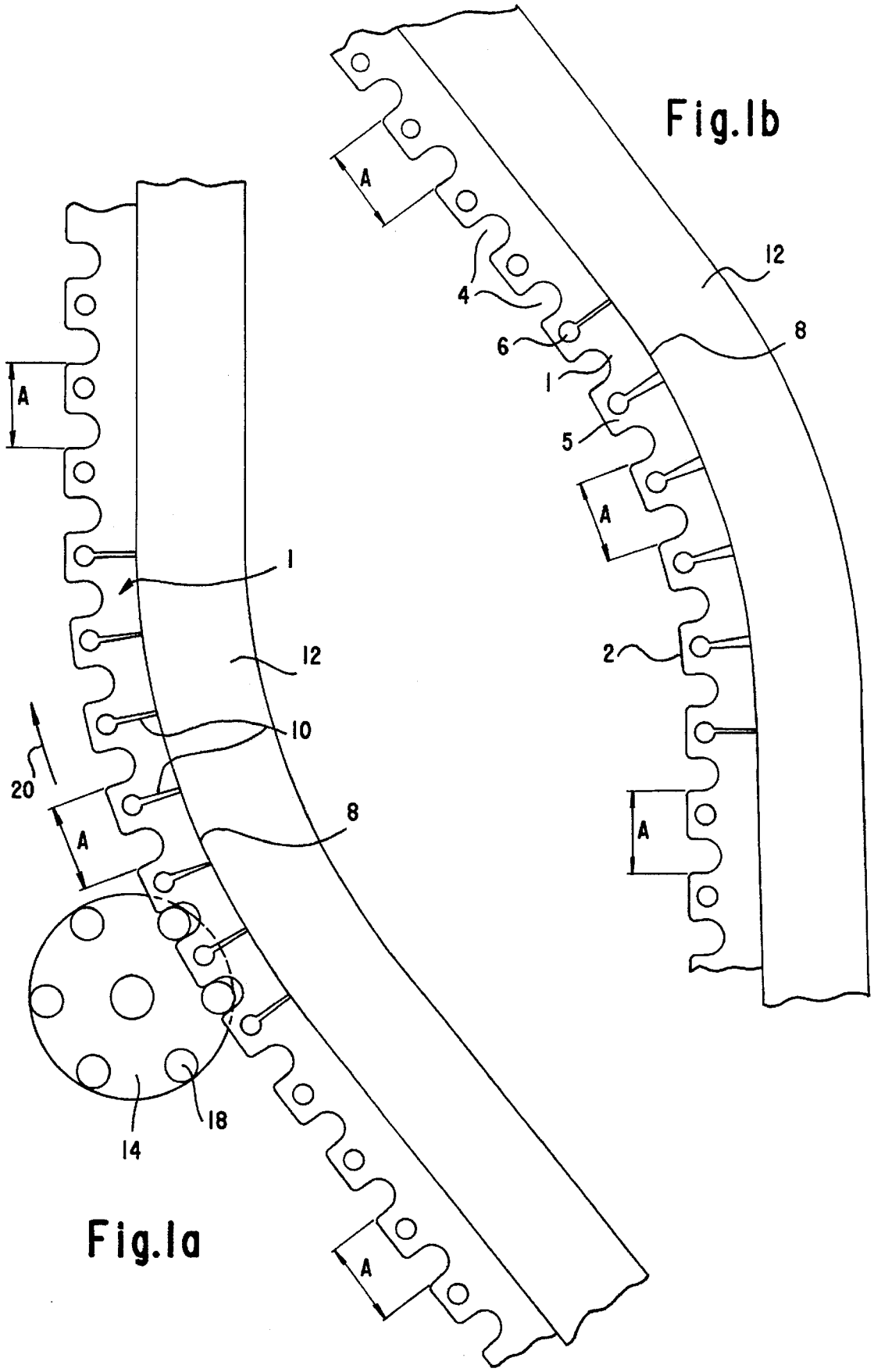
FIGS. 1*a* and 1*b* are fragmentary, diagrammatic, side-elevational views of a driving strip to be secured to a supporting tube and having different curvatures.

Referring now to the figures of the drawing in detail and first, particularly, to FIGS. 1*a* and 1*b* thereof, the basic concept of the invention can be seen from a driving strip 1 which is permanently disposed on one of normally two supporting tubes, walings or spars 12 that are present in a freight elevator. The drive described below is especially suitable for elevators for the handicapped, of the kind that must usually be retrofitted into a stairwell of a residence. As a rule, the problem is to adapt such a stair climber to the various slopes and radii of curvature of the stairway. The driving strip 1 according to the invention is made from a relatively thick flat iron bar, and along its one edge, which is referred to below as the outer edge 2, it has U-shaped recesses 4 of identical pitch with a constant spacing A. The sides of the recesses 4 have parallel outer regions and a bottom at which they change into a cylindrical jacket-like half shell. Webs 5 remain between the recesses 4 and bores 6 which are formed in the middle of the webs 5 have a diameter that is on the order of magnitude of approximately one-third of the length of the webs.

The driving strip 1 also has an inner edge 8 of the flat iron bar that is opposite the outer edge 2. The driving strip 1 can be bent, in the plane of its broad flat side, over a wide range of the radius of curvature if rectangularly constructed notches 10 aimed at the centers of the bores 6 are made in the inner edge 8. These notches 10 are naturally made only in the region that requires bending of the driving strip, in order to enable perfect contact with the supporting tube 12. In the case of a concave bend of the driving strip 1 as is shown in FIG. 1*b*, the notches 10 would widen toward the inner edge 8, as shown. It is therefore necessary for the notches 10, in the regions of the driving strip 1 that require a convex curvature as FIG. 1*a* shows, to be constructed to be sufficiently V-shaped prior to the bending. Securing of the driving strip 1 to the supporting tube 12 after the bending is expediently carried out through the use of welds.

FIG. 1*a* diagrammatically suggests a way in which the drive of a load-receiving configuration is effected with a motor-driven drive wheel 14. By way of example, the drive wheel may include two circular disks 16 that are spaced apart from one another and between which a plurality of rotatably supported rollers 18, for instance six in number are disposed, at the spacing A on a pitch circle. The rollers 18 have an outer diameter that is adapted to the spacing between the parallel sides of the U-shaped recesses. The drive wheel 14 is supported at such a distance from the outer edge 2 of the driving strip 1 that at least one roller 18 is in engagement with one of the U-shaped recesses 4. In the situation shown in FIG. 1*a*, two rollers are precisely in identical engagement in two adjacent recesses. Upon a clockwise rotation of the drive wheel 14, the drive wheel 14 is moved upward in the direction of an arrow 20 along the driving strip 1.

Figure 2:
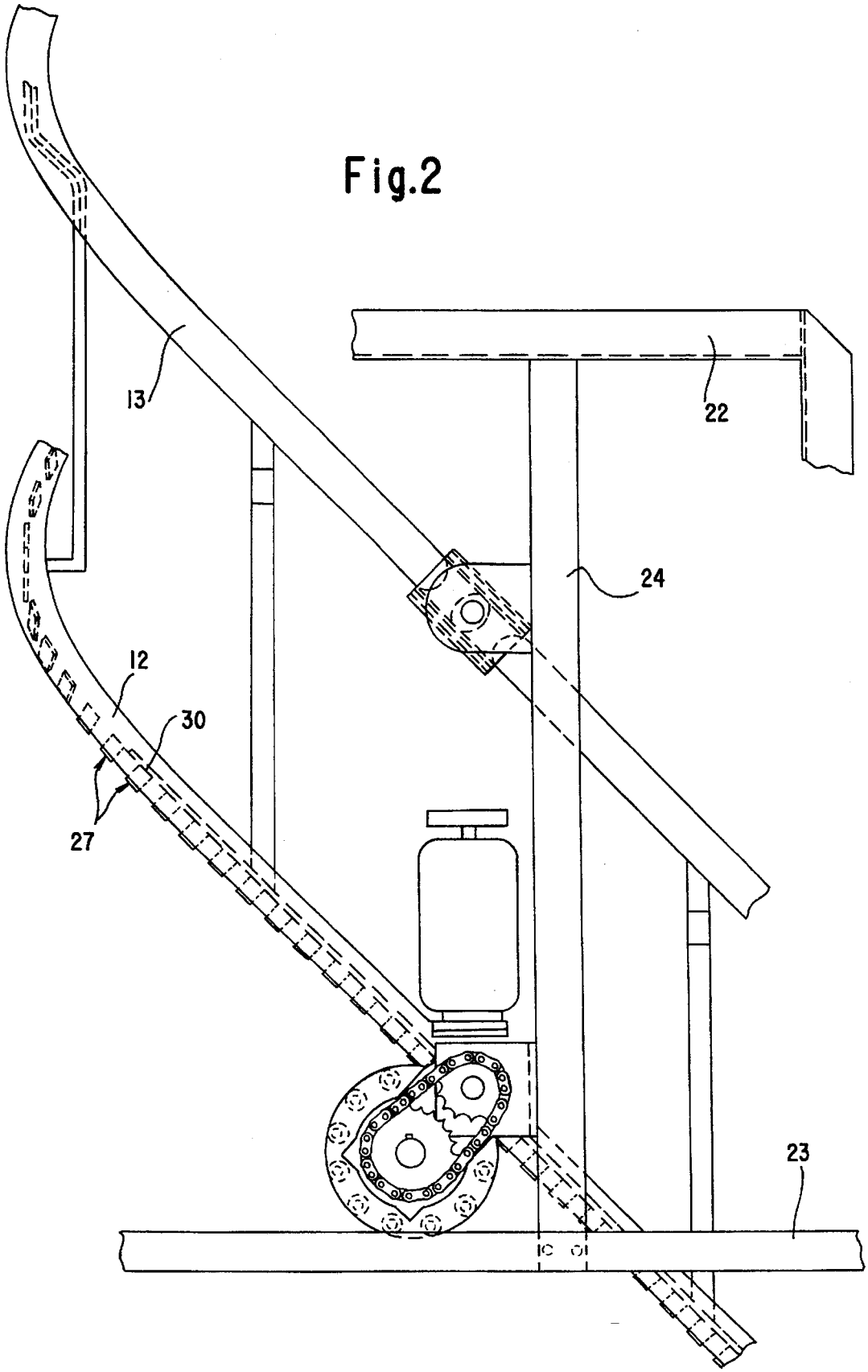
FIG. 2 is a reduced, fragmentary, side-elevational view showing a combination of the supporting tube and the driving strip of the drive on a load-receiving configuration.
Figure 3:
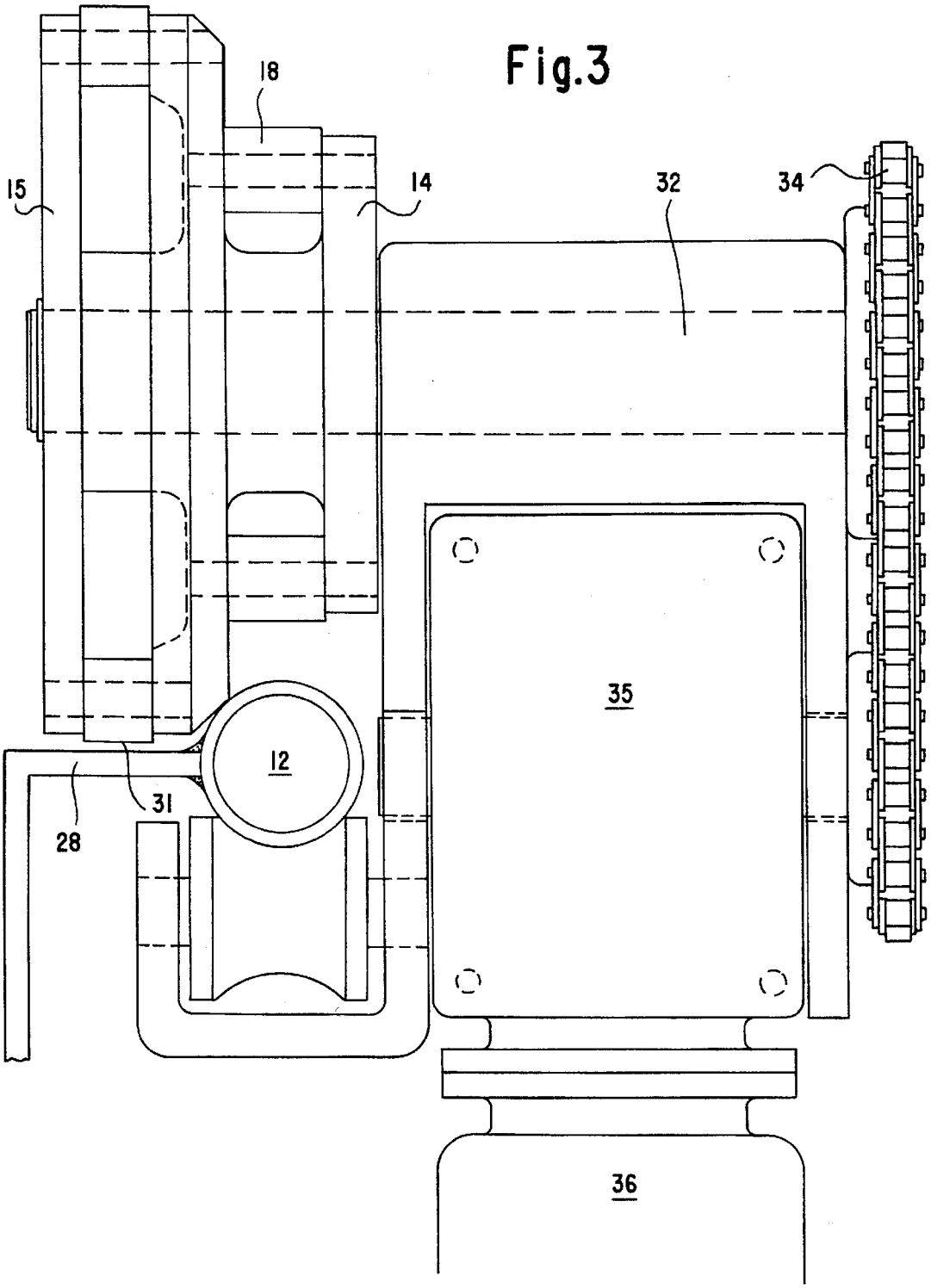
FIG. 3 is an enlarged, fragmentary, front-elevational view of a drive for two speeds, with the supporting tube having a parallel-guided additional driving strip.
Figure 4:
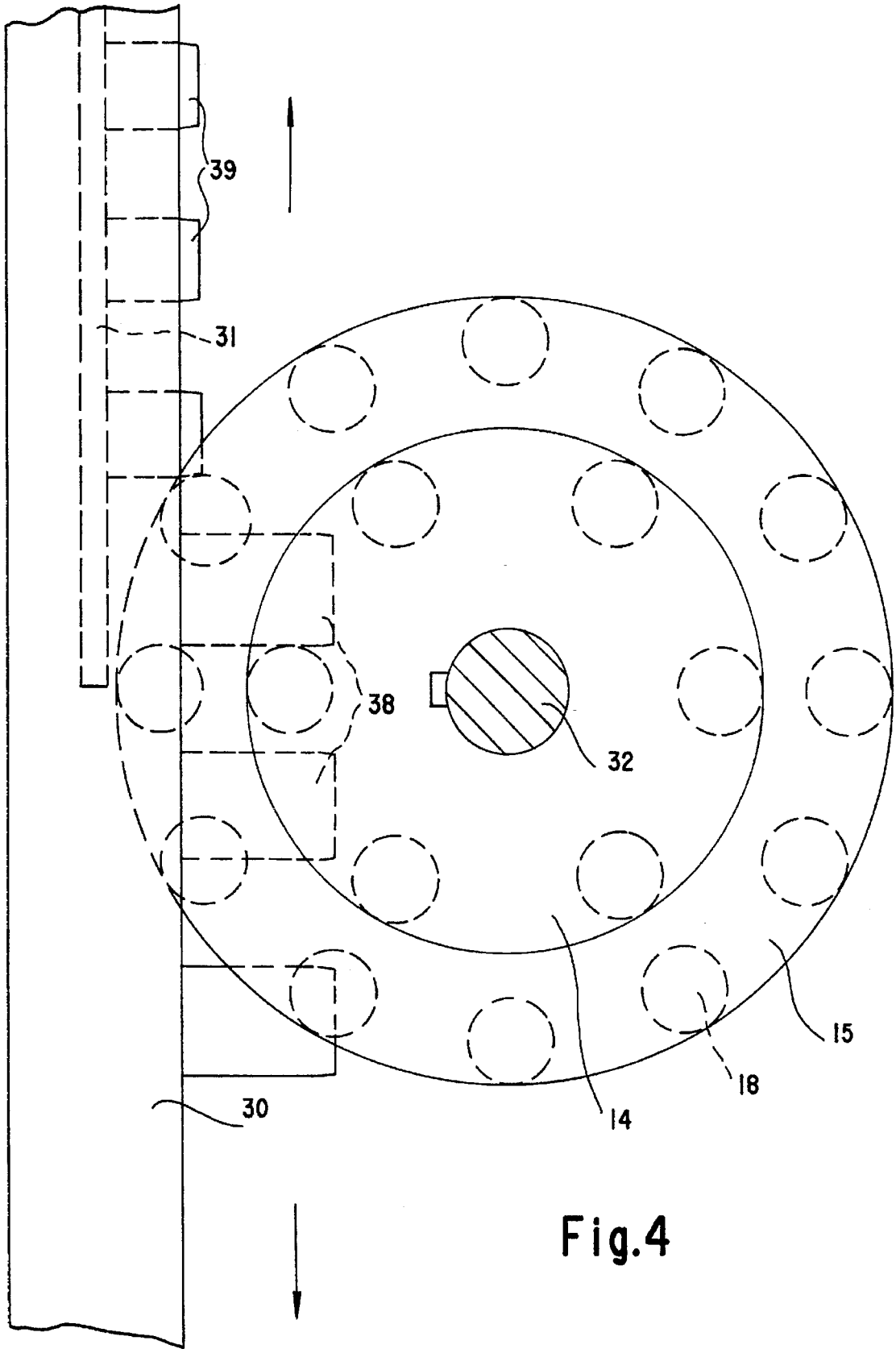
FIG. 4 is a fragmentary, side-elevational view of the disposition of FIG. 3.

In FIGS. 2–4, an exemplary embodiment that employs the driving principle explained in conjunction with FIGS. 1*a* and 1*b* is shown. This embodiment enables two different speeds for the motion of the load-receiving configuration along the supporting tube 12 and a supporting tube 13 of a stair climber, for instance a faster speed along a straight path and a slower speed in the region of a curve in the path.

The load-receiving configuration shown in FIG. 2 is illustrated in suggested fashion with an upper frame part 22, a lower frame part 23, and a vertical supporting carrier 24 that connects these two parts. The load-receiving configuration 22–24 is guided by at least two roller guides 26 along the two supporting tubes 12 and 13. The lower supporting tube 12 is combined with two side-by-side driving strips, namely the driving strip 1 and another driving strip 30, which overlap in a short region at reference numeral 27, in an area where the straight path changes into the curved region. As can be seen from FIG. 3, the small drive wheel 14 (with six rollers 18) cooperates with the driving strip 1, which is secured directly to the lower guide tube 12 as is shown in FIG. 1*a*, while a large drive wheel 15 cooperates with the other driving strip 30 that is secured to literally bent retaining webs 28 of the lower supporting tube 12. FIG. 4 illustrates the region of the overlap 27, in which the drive of the drive wheels 14 and 15 changes over from engagement with the driving strip 1 to engagement with the driving strip 30. Both drive wheels 14 and 15 are secured on a drive shaft 32, which is connected through a chain drive 34 to a transmission 35 of a motor 36.

The embodiment of the driving strip can be simplified and modified in a manner that can be learned from the diagrammatic side view of FIG. 4. A decisive factor for the sake of undisturbed, quiet operation of the drive described above is that the spacing A of FIGS. 1*a* and 1*b* be accurately maintained, and the spacing of the roller bearing of the drive wheel 14 must be adjusted to this spacing as well. The driving strips 1 and 30 shown in FIGS. 2–4 can be replaced with squared blocks 38 and 39, but these must be disposed directly on the guide tube 12 or on a support strip 31, with very accurate alignment and each with constant spacing.

I claim:

1. A freight elevator drive assembly, comprising:

at least one supporting waling;

a driving strip disposed on said supporting waling, said driving strip having recesses formed therein at equal intervals;

a load-receiving configuration having a motor-driven drive wheel; and drive elements being adapted to said recesses for form-lockingly engaging said drive wheel with said recesses;

said driving strip having an outer edge and said recesses being formed in said outer edge in the shape of a U with parallel sides.

2. The drive assembly according to claim 1, wherein said driving strip has an inner edge opposite said outer edge, and said inner edge has notches formed therein at equal intervals.

3. The drive assembly according to claim 2, wherein said driving strip has webs between said recesses, said webs have centers at which bores are formed at right angles to a lengthwise extension of said driving strip, and said notches terminate in said bores.

4. A drive assembly for a stair climber for the handicapped, comprising:

at least one supporting waling;

a driving strip disposed on said supporting waling, said driving strip having recesses formed therein at equal intervals;

a load-receiving configuration having a motor-driven drive wheel; and drive elements being adapted to said recesses for form-lockingly engaging said drive wheel with said recesses;

said driving strip having an outer edge and said recesses being formed in said outer edge in the shape of a U with parallel sides.

5. A freight elevator drive assembly, comprising:

at least one supporting waling;

squared blocks of constant length being secured to said supporting waling at equal spacings;

a load-receiving configuration having a motor-driven drive wheel; and drive elements being adapted to said spacings of said blocks for form-lockingly engaging said squared blocks with said drive wheel.

6. A drive assembly for a stair climber for the handicapped, comprising:

at least one supporting waling;

squared blocks of constant length being secured to said supporting waling at equal spacings;

a load-receiving configuration having a motor-driven drive wheel; and drive elements being adapted to said spacings of said blocks for form-lockingly engaging said squared blocks with said drive wheel.

* * * * *

UNITED STATES PATENT AND TRADEMARK OFFICE

CERTIFICATE OF CORRECTION

PATENT NO : 5,641,040

DATED : June 24, 1997

INVENTOR(S) : Gerd Grass

It is certified that error appears in the above-identified patent and that said Letters Patent is hereby corrected as shown below:

On the title page, insert

Item [22] should read as follows:

Apr. 6, 1993 [DE] Germany ..... 43 10 806.7

Signed and Sealed this

Twenty-fourth Day of October, 2000

*Attest:*

*Attesting Officer*

Q. TODD DICKINSON

*Director of Patents and Trademarks*